US009302805B2

(12) United States Patent
Derrien et al.

(10) Patent No.: US 9,302,805 B2
(45) Date of Patent: Apr. 5, 2016

(54) BOTTOM OF A HOLLOW BODY OBTAINED BY BLOWING OR STRETCH-BLOWING A PREFORM OF A THERMOPLASTIC MATERIAL, AND HOLLOW BODY COMPRISING SUCH A BOTTOM

(75) Inventors: Mikael Derrien, Octeville sur Mer (FR); Michel Boukobza, Octeville sur Mer (FR)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 2169 days.

(21) Appl. No.: 12/376,350

(22) PCT Filed: Jul. 13, 2007

(86) PCT No.: PCT/FR2007/001207

§ 371 (c)(1),
(2), (4) Date: Sep. 6, 2011

(87) PCT Pub. No.: WO2008/017746

PCT Pub. Date: Feb. 14, 2008

(65) Prior Publication Data

US 2011/0309090 A1 Dec. 22, 2011

(30) Foreign Application Priority Data

Aug. 8, 2006 (FR) ..... 06 07212

(51) Int. Cl.
*B65D 1/02* (2006.01)

(52) U.S. Cl.
CPC ..... *B65D 1/0284* (2013.01); *B65D 1/0261* (2013.01)

(58) Field of Classification Search
CPC .. B65D 1/0284; B65D 1/0276; B65D 1/0261; B65D 1/42; B65D 1/44; B65D 23/001; B65D 2501/0018; B29B 2911/1404; B29B 2911/14326; B29B 2911/14333; B29B 2911/14093; B29C 49/04; B29C 49/06; B29C 49/48; B29C 49/541
USPC ..... 215/370–377, 382; 220/606, 608, 610; 428/36.92, 66.3, 35.7; D9/516, 520
See application file for complete search history.

(56) References Cited

U.S. PATENT DOCUMENTS 4,301,933 A * 11/1981 Yoshino ..... 215/375
4,598,831 A * 7/1986 Nakamura et al. ..... 215/373

(Continued)

FOREIGN PATENT DOCUMENTS

EP 0 671 331 A1 9/1995
FR 2 753 435 A1 3/1998

(Continued)

*Primary Examiner* — Bryon Gehman
*Assistant Examiner* — Brijesh V. Patel
(74) *Attorney, Agent, or Firm* — Sughrue Mion, PLLC

(57) ABSTRACT

A bottom (2) of a hollow body obtained by blowing or stretch-blowing a preform of a thermoplastic material. The bottom (2) includes a transverse support surface (4) and, on either side of the transverse support surface (4), a transverse outer edge (5) and a concave inner wall with a transverse central portion (10) having a pellet (11) of a low-crystallinity material. The pellet corresponds to the injection point of the perform. The bottom (2) has reinforcing ribs (1) having an outer edge (12) adjacent to the outer edge (5) of the bottom (2) as well as an inner edge (13) adjacent to the transverse central portion (10) but not reaching the transverse central portion (10). The reinforcing ribs (1) flare from their outer edge (12) toward their inner edge (13).

13 Claims, 2 Drawing Sheets

(56) References Cited

U.S. PATENT DOCUMENTS

| | | | | | |
|---|---|---|---|---|---|
| 4,620,639 | A | * | 11/1986 | Yoshino | 215/373 |
| 4,892,205 | A | * | 1/1990 | Powers et al. | 215/375 |
| 5,071,015 | A | * | 12/1991 | Kinslow | 215/375 |
| 5,549,210 | A | * | 8/1996 | Cheng | 215/375 |
| 5,713,480 | A | * | 2/1998 | Petre et al. | 215/373 |
| 5,763,030 | A | * | 6/1998 | Matsui | 428/35.7 |
| 5,785,197 | A | * | 7/1998 | Slat | 215/375 |
| 6,019,236 | A | * | 2/2000 | Slat | 215/375 |
| D595,581 | S | * | 7/2009 | Brunson | D9/520 |
| D705,068 | S | * | 5/2014 | Janssen et al. | D9/516 |
| 2002/0063105 | A1 | * | 5/2002 | Darr et al. | 215/373 |
| 2004/0211746 | A1 | * | 10/2004 | Trude | 215/374 |
| 2005/0127024 | A1 | * | 6/2005 | Darr | 215/382 |
| 2007/0045220 | A1 | * | 3/2007 | Pedmo et al. | 215/375 |
| 2007/0262046 | A1 | * | 11/2007 | Zoppas | 215/375 |
| 2008/0035601 | A1 | * | 2/2008 | Derrien | 215/376 |
| 2008/0113060 | A1 | * | 5/2008 | Richards et al. | 425/393 |
| 2009/0130246 | A1 | * | 5/2009 | Tonga | B29C 33/46 425/537 |
| 2009/0308835 | A1 | * | 12/2009 | Boukobza | 215/370 |
| 2010/0032404 | A1 | * | 2/2010 | Colloud | 215/371 |
| 2010/0297375 | A1 | * | 11/2010 | Protais et al. | 428/36.92 |

FOREIGN PATENT DOCUMENTS

| | | | |
|---|---|---|---|
| GB | 2 267 881 | A | 12/1993 |
| WO | 99/12817 | A1 | 3/1999 |

* cited by examiner

BOTTOM OF A HOLLOW BODY OBTAINED BY BLOWING OR STRETCH-BLOWING A PREFORM OF A THERMOPLASTIC MATERIAL, AND HOLLOW BODY COMPRISING SUCH A BOTTOM

CROSS REFERENCE TO RELATED APPLICATIONS

This application is a National Stage of International Application No. PCT/FR2007/001207 filed Jul. 13, 2007, claiming priority based on French Patent Application No. 0607212 filed Aug. 8, 2006, the contents of all of which are incorporated herein by reference in their entirety.

The invention relates to the technical field of hollow bodies made of thermoplastic material, particularly containers such as jars or bottles.

More particularly, the invention relates to hollow bodies obtained by blowing or stretching then blowing an injected preform made of thermoplastic material (injection-blowing).

For several years the manufacture of containers of plastic material from previously injected preforms has experienced considerable expansion, particularly due to the use of polyethylene terephtalate (PET).

Meanwhile, other materials have been considered and/or used with more or less success. Non-limiting examples of such materials are polyethylene naphtalate (PEN), polypropylene (PP), polyacrylonitrile (PAN), or mixtures or overlays of various materials.

Generally at the center of the bottom of the hollow body a zone of very low crystallinity called "pellet" resulting from part of the preform that is only weakly stretched during the blowing or stretch-blowing. Indeed, the longitudinal axis of the preform corresponds to that of the final container. This results in the fact that during the blowing or stretch-blowing, the stretching of the PET is nearly zero at the center of the bottom of the container, and increases as the side wall of the container is approached.

When conventional bi-oriented PET containers are taken to a temperature higher than the glass transition temperature, they undergo significant shrinkage due to release of stresses.

To compensate for this problem, it has long been known to perform a heat treatment called "heat setting," a treatment in which, just after the blowing of the preform and while the container is still in contact with the walls of the blow mold, a temperature between about 120° C. and 250° C. is applied to the material for several seconds. The container is then cooled while keeping it under pressure.

This heat treatment promotes crystalline growth. In the amorphous part of the bottle (especially in the central zone of the bottom corresponding to the injection point of the preform), this heat treatment causes the growth of spherolites, said spherolitic crystallization being slow and isotropic. The material of the "pellet" becomes whitish and opaque. However, in the other parts of the bottle, which have undergone the bi-orientation, the heat treatment increases the crystallinity without the formation of spherolites and without changing the transparency of the material.

Irrespective of their manufacturing process, containers made of thermoplastic material must have good strength in their bottom.

Bi-oriented PET has good mechanical strength and thermal resistance. However, as was mentioned above, the bottom of the containers is much less stretched than the body of the containers, so the mechanical strength and thermal resistance of the bottom is less than that of the body.

The same problem exists for the neck. The heat treatment of the necks makes it possible to increase their crystallinity. But the heat treatment of necks (in amorphous PET) leads to an isothermal crystallization forming spherolites, so the resulting hardened thermo PET is no longer translucent. Even though it may be acceptable for the necks of bottles, relatively thick, not to be translucent, a bottle bottom that is not very translucent would spoil the presentation of the product contained therein.

The bottom of the container must be impact resistant, for example when the container is dropped.

The container bottom must withstand internal pressure, particularly when the container contains a carbonated beverage. Excess internal pressure can result from an increase in the storage temperature of the full bottles and/or the shrinkage of the plastic materials of these bottles, said shrinkage generally occurring over the course of two or three weeks following their manufacture and filling.

The bottles are transported palletized and stacked. Thus, unless separator materials are used, the bottoms of the bottles of the upper layers rest on the caps of the lower bottles and are subject to compressing and crushing stresses.

Any deformation of the bottom of the container affects the aesthetics of the product and the stability of the container when stored upright.

The container bottom must be resistant to creep.

The container in its entirety, and in particular its bottom, must be resistant to the relatively severe heat conditions encountered during hot filling or pasteurization.

During hot filling with a liquid at a temperature of at least 94° C., the bottom must have a relative deformability. This is also true during the subsequent cooling, since the bottom must withstand the drop in pressure (vacuum compensation).

Any deformation of the bottom of the container affects the aesthetics of the product and the stability of the container stored upright.

Moreover, the bottom of containers must sometimes withstand cleaning agents, in the case of reusable containers.

It has been proposed to produce the containers with petaloid bottoms. The bottom wall is then generally convex in shape toward the exterior and includes feet, typically four to six feet formed by protuberances regularly distributed on the bottom and separated two by two by a portion of the convex bottom wall. These petaloid bottoms are widely used for containers containing carbonated beverages. The radial recesses separating the feet absorb the stresses due to pressurization during filling and maintain the support spans of the feet in a plane substantially perpendicular to the axis of the container. This solution is not always satisfactory. Under the effect of internal pressure, petaloid bottoms can burst. Petaloid bottoms cannot always withstand the excess pressure due to the increased volume of the contents of the bottle during pasteurization.

It has also been proposed to produce grooved bottom bottles, such as the ribbed "champagne" type. The document FR 2 717 443 describes a bottle in which the ribs start from the periphery of the bottom and end at the outer limit of a substantially flat annular zone surrounding an amorphous concave central part. The applicant's document FR 2 753 435 describes a container whose bottom includes a non-stretched central part and a peripheral part connecting the central part to the side wall of the container, said bottom being provided with ribs extending from the side wall to the theoretical outer limit of the non-stretched central part. Said theoretical outer limit takes into account slight fluctuations in the shape and dimensions of the central part of the bottom (pellet), from one bottle to another in the same series. No rib terminates in the amorphous part.

As it happens, although the bottoms from the prior art resolve only some of the problems mentioned, none is capable of recovering its initial shape after being dropped and subsequent deformation, whether it is full or not.

The invention seeks to provide a new bottle bottom structure, all of the individual characteristics of which make it possible to obtain a strength that exceeds that of most currently known bottoms, and allows it to "naturally" recover its shape after a stress (such as being dropped or other stress) causes its deformation.

For an identical wall thickness, a bottom according to the invention will be stronger than most previously known bottle bottoms.

For a desired strength, a bottom according to the invention can be produced with less thickness of material than most previously known bottoms.

The invention also seeks to provide a bottle having good strength for hot filling and good strength for pasteurization.

According to a first aspect, the invention relates to a bottom of hollow body obtained by blowing or stretch-blowing of a preform of thermoplastic material, said bottom comprising a transverse support surface, and on either side of said transverse support surface:

- a transverse outer edge;
- a concave inner wall with a transverse central part containing a pellet of material of low crystallinity, said pellet corresponding to the injection point of the preform;

said bottom comprising reinforcing ribs having an outer edge in proximity to the outer edge of the bottom, said reinforcing ribs having an inner edge in proximity to the transverse central part but without reaching said transverse central part, the reinforcing ribs flaring out from their outer edge toward their inner edge.

According to various embodiments, the hollow body bottom has the following characteristics, combined as needed:

- the reinforcing ribs do not reach the outer edge of the bottom;
- the reinforcing ribs have a bottom wall of substantially constant width over the whole length of said ribs;
- at least one rib has a plane of vertical symmetry;
- both lateral flanges of each rib provided with a plane of symmetry are substantially facing each other at the extreme distal part of said ribs, and particularly adjacent to their outer edge;
- the pellet of material of low crystallinity projects from the outer face in the transverse central part. This arrangement ensures a separation between the reinforcing ribs and said pellet;
- the outer edge is placed at a height h5 with respect to the transverse support surface, the transverse central part being placed at a height h10 with respect to the transverse support surface.

In one advantageous embodiment, with the exception of the reinforcing ribs, the bottom is in the form of a body of revolution around an axis substantially perpendicular to its transverse support surface.

In one advantageous embodiment, in vertical radial cross-section, between the outer edge and the transverse support surface, the bottom has a profile that is:

- adjacent to the outer edge, substantially tangent to a direction perpendicular to the transverse support surface,
- adjacent to the transverse support surface, substantially tangent to said transverse support surface.

Advantageously, in vertical radial cross-section between the outer edge and the transverse support surface, the bottom has a substantially parabolic profile.

Advantageously, the bottom has a transverse support surface that is annular in shape. Starting from said annular surface and proceeding toward the axis of revolution, the bottom advantageously first has an annular step, then a substantially parabolic profile connecting said step to the transverse central part.

According to a second aspect, the invention relates to a hollow body of thermoplastic material, especially a polyester such as PET, obtained by blowing or stretch-blowing of a preform, said hollow body comprising a side wall and a bottom joined to said side wall, said bottom being as presented above.

Other objects and advantages of the invention will become apparent from the following description of embodiments, provided by way of non-limiting examples, said description being made with reference to the appended drawings in which.

Figure 1:
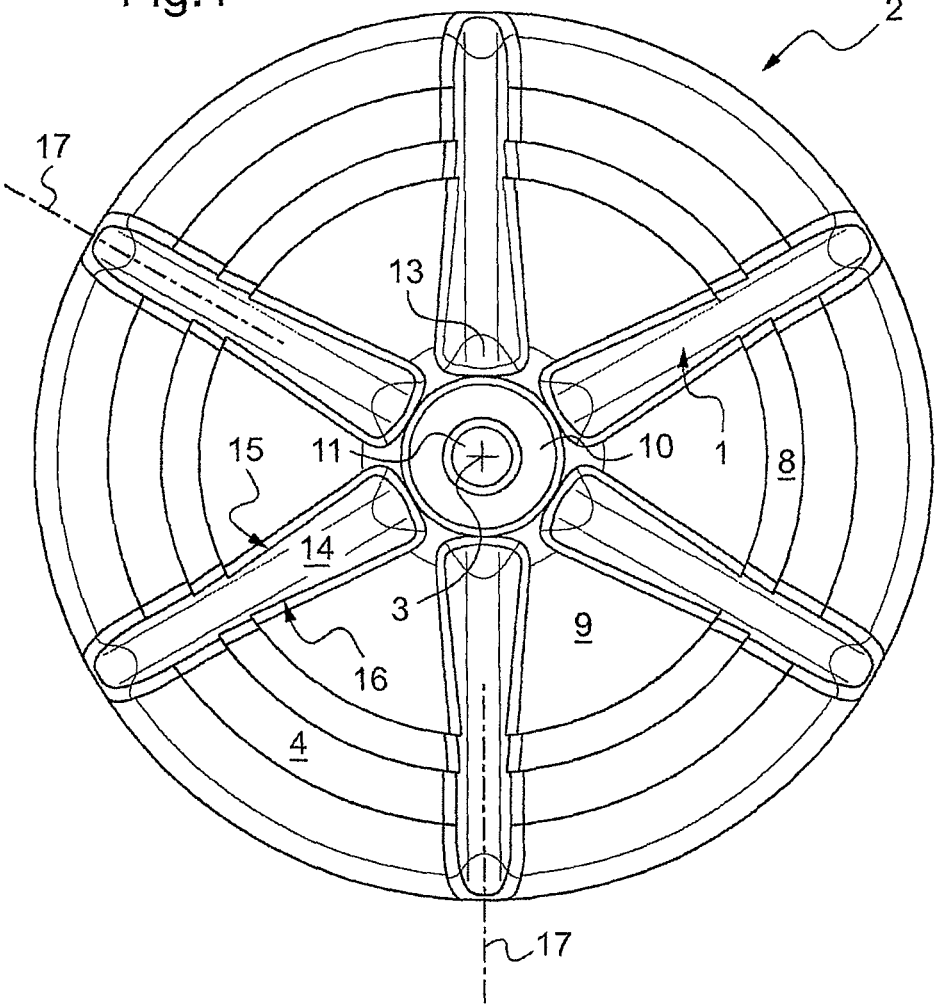
FIG. 1 is a bottom view of a hollow body bottom such as a bottle, according to one embodiment of the invention.
Figure 2:
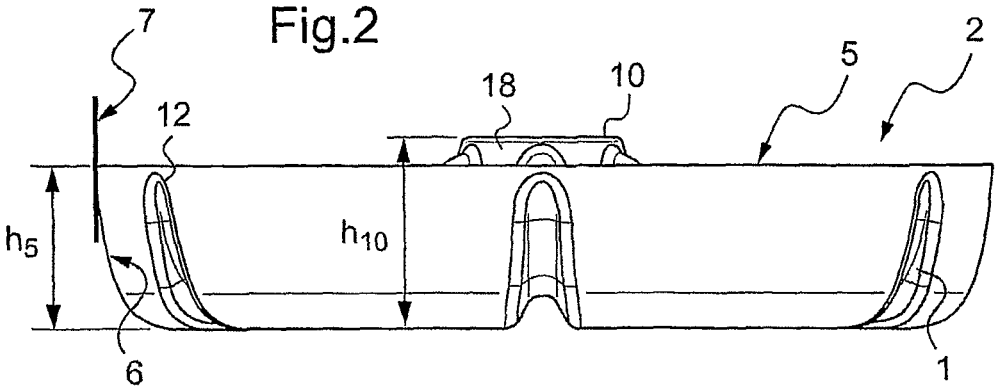
FIG. 2 is a side view of the bottom represented in FIG. 1.
Figure 3:
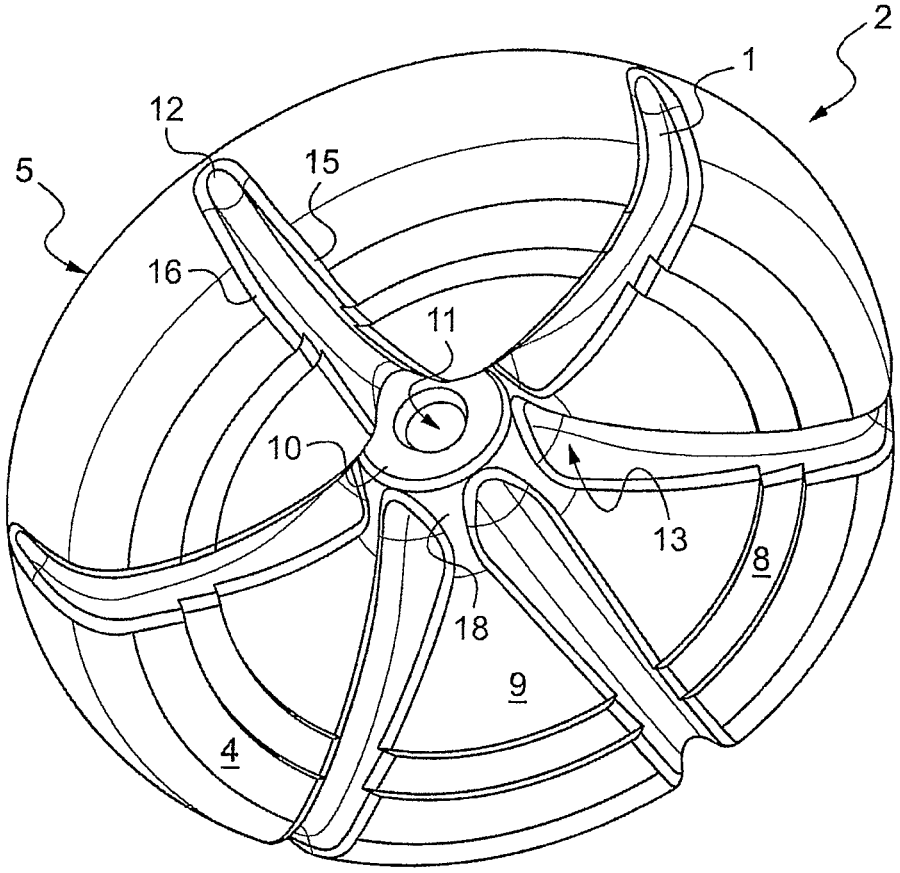
FIG. 3 is a view in perspective of the bottom represented in FIGS. 1 and 2.

With the exception of the six reinforcing ribs 1, the bottom 2 is in the form of a body of revolution around an axis 3 substantially perpendicular to its transverse support surface 4.

For this reason, and for purposes of simplification, the bottom 2 will first be described while ignoring the reinforcing ribs 1, said reinforcing ribs 1 being the subject of a subsequent detailed description.

The bottom 2 will be described starting from its outer edge 5 and proceeding radially toward the axis of revolution 3.

The outer edge 5 is transverse and corresponds substantially to the junction between the bottom 2 and the side wall of the container (not shown). Said outer edge 5 is placed at a height h5 with respect to the transverse support surface 4 of the bottom 2 (and of the bottle comprising said bottom 2, when said bottle is stored upright).

Between the outer edge 5 and the transverse support surface 4, the bottom has in vertical radial cross-section a substantially parabolic profile. Adjacent to the outer edge 5, said profile 6 is substantially tangent to a direction 7 perpendicular to the transverse support surface 4. Adjacent to the transverse support surface 4, said profile 6 is substantially tangent to said transverse support surface 4. The profile 6 thus provides a solution for continuity with unbroken curvature between the side wall of the container (not shown) and the transverse support surface 4.

The bottom 2 has an annular shaped transverse support surface 4. Starting from this transverse support surface 4 and proceeding toward the axis of revolution 3, the bottom 2 has an annular step 8 of a width (measured radially) substantially equal to the width of the annular transverse support surface 4. Said annular step 8 allows the deformation of the bottom 2 like a bellows, under the effect of excess pressure or a vacuum in the hollow body provided with such a bottom.

Starting from said annular step 8 and proceeding toward the axis of revolution 3, the bottom 2 then has, in vertical radial cross-section, a substantially parabolic profile 9 then a transverse central part 10.

The transverse central part 10 is placed at a height h10 with respect to the transverse support surface 4, said height h10 being greater than the height h5 of the outer edge 5.

An axial pellet 11 projects from the transverse central part 10, said axial pellet 11 projecting downward, that is, the exterior of the container provided with the bottom 2.

The radial reinforcing ribs will now be described.

Said reinforcing ribs 1 have an outer edge 12 in proximity to the outer edge 5 of the bottom 2. As illustrated, preferably the outer edge 12 of the reinforcing ribs 1 do not reach said outer edge 5 of the bottom 2, although this is perfectly possible and in no way changes the qualities of the bottom; it is even possible to alternate ribs that reach the outer edge with others that do not.

Said reinforcing ribs 1 have an inner edge 13 in proximity to the transverse central part 10, but without reaching said transverse central part 10.

Each reinforcing rib 1 comprises a bottom wall 14 and a flange 15, 16 on either side of said bottom wall 14. The bottom wall 14 is of substantially constant width along the full length of the rib. Viewed in cross section, each reinforcing rib 1 has a plane 17 of radial vertical symmetry and the bottom wall 14 has a contour substantially identical to the one formed by the profile 6, the transverse support surface 4, and the profile 9. Viewed in a plane perpendicular to its curvature, the bottom wall 14 is substantially flat or slightly curved.

The two lateral flanges 15, 16 are substantially facing each other at the extreme distal part of the ribs, and particularly adjacent to their outer edge 12.

The two lateral flanges 15, 16 are separated from each other and flare more and more as they near the axis of revolution 3. Adjacent to their inner edge 13, the reinforcing ribs 1 thus have a very open U-shaped cross-section when said reinforcing ribs 1 are viewed in a plane perpendicular to their bottom wall 14.

The reinforcing ribs 1 thus back up against a central chimney 18 at the center of which the pellet 11 protrudes downward, said central chimney 18 being limited at the top by the transverse central part 10.

All of the individual characteristics of the bottle bottom make it possible to obtain a strength that is greater than that of most currently known bottoms. For an identical wall thickness, a bottom according to the invention will be stronger than most previously known bottle bottoms. For a desired strength, a bottom according to the invention can be produced with a thickness of material that is less than most previously known bottoms.

A bottle comprising a bottom according to the invention has good strength in hot filling and good strength in pasteurization. The central chimney 18 is particularly well reinforced with regard to creep or sag by the presence of the reinforcing ribs 1 flaring from their distal end (where said ribs have a U-shaped cross section with substantially parallel and short flanges) to their proximal end (where said ribs have a very open U-shape with longer, curved flanges).

A bottle comprising a bottom according to the invention also has good impact resistance on the lower part of the lateral wall, the ribs extending beyond said lower part. The bottom perfectly absorbs impacts and is capable of "naturally" recovering its initial shape after deformation.

In the embodiment shown, there are six substantially identical and equidistant reinforcing ribs 1. In other embodiments, the reinforcing ribs are more or less numerous, especially in order to take into account the diameter of the bottom. The reinforcing ribs can be of different dimensions, a first series having a narrower bottom wall than the bottom wall of a second series of ribs.

The invention claimed is:

1. A bottom of a hollow body, the hollow body being obtained by blowing or stretch-blowing a preform of thermoplastic material, said bottom comprising a transverse support surface, and on either side of said transverse support surface:

a transverse outer edge;

a concave inner wall with a transverse central part containing a pellet of material of low crystallinity, said pellet corresponding to an injection point of the preform;

said bottom comprising reinforcing ribs, each reinforcing rib having a respective outer edge in proximity to the transverse outer edge of the bottom, each of the reinforcing ribs having an inner edge in proximity to the transverse central part but without reaching said transverse central part, wherein each of the reinforcing ribs flare outs from the respective outer edge towards the respective inner edge, and wherein the transverse outer edge is placed at a first height with respect to the transverse support surface, the transverse central part being placed at a second height with respect to the transverse support surface, the second height of the transverse central part being greater than the first height of the transverse outer edge, each of the reinforcing ribs having a bottom wall of substantially constant width over the whole length of the reinforcing rib.

2. The bottom of the hollow body as claimed in claim 1, wherein the respective outer edge of each of the reinforcing ribs does not reach the transverse outer edge.

3. The bottom of the hollow body as claimed in claim 1, wherein at least one of the reinforcing ribs has a plane of vertical symmetry.

4. The bottom of the hollow body as claimed in claim 3, wherein each reinforcing rib has two lateral flanges and wherein the two lateral flanges of each reinforcing rib across a plane of symmetry are substantially facing each other at an extreme distal part of said reinforcing rib adjacent to the respective outer edge.

5. The bottom of the hollow body as claimed in claim 1, wherein the pellet of material of low crystallinity projects from an outer face in the transverse central part.

6. The bottom of the hollow body as claimed in claim 1, wherein, with the exception of the reinforcing ribs, the bottom is in the form of a body of revolution around an axis substantially perpendicular to the transverse support surface.

7. The bottom of the hollow body as claimed in claim 6, wherein, in a vertical radial cross-section, between the transverse outer edge and the transverse support surface, the bottom has the profile that is in a portion adjacent to the outer edge, substantially tangent to a direction perpendicular to the transverse support surface, and in a portion adjacent to the transverse support surface, substantially tangent to said transverse support surface.

8. The bottom of the hollow body as claimed in claim 7, comprising, in the vertical radial cross-section between the transverse outer edge and the transverse support surface, a substantially parabolic profile.

9. The bottom of the hollow body as claimed in claim 7, wherein the transverse support surface is annular in shape.

10. The bottom of the hollow body as claimed in claim 9, wherein, starting from said transverse support surface and proceeding toward an axis of revolution of the bottom, the bottom first has an annular step, then a substantially parabolic profile connecting said annular step to the transverse central part.

11. A hollow body of thermoplastic material obtained by blowing or stretch-blowing of a preform, said hollow body comprising a side wall and a bottom joined to said side wall, wherein said bottom is as presented in claim 1.

12. The hollow body according to claim 11, wherein the thermoplastic material is PET.

13. A hollow body obtained by blowing or stretch-blowing a preform of thermoplastic material, the hollow body comprising:

a bottom, the bottom comprising:

a transverse support surface;

a transverse outer edge;

a concave inner wall with a transverse central part containing a pellet of material of low crystallinity, the pellet corresponding to an injection point of the preform;

reinforcing ribs extending radially beyond the support surface and each reinforcing rib having a respective outer edge in proximity to the transverse outer edge of the bottom and an inner edge in proximity to the transverse central part without reaching the transverse central part, each reinforcing rib flares outs from the respective outer edge towards the respective inner edge, and the respective outer edge is at a first height with respect to the transverse support surface, the transverse central part is at a second height with respect to the transverse support surface, and the second height of is greater than the first height, each of the reinforcing ribs having a bottom wall of substantially constant width over the whole length of the reinforcing rib.

* * * * *